US005256099A

United States Patent [19]

Rudell et al.

[11] Patent Number: 5,256,099

[45] Date of Patent: Oct. 26, 1993

[54] CONTACT-ACTIVATED PRESSURIZED WATER RELEASE TOY

[75] Inventors: Elliot A. Rudell, 6556 Sattes Dr., Rancho Palos Verdes, Calif. 90274; George T. Foster, Signal Hill; Ian B. Osborne, Manhattan Beach, both of Calif.

[73] Assignee: Elliot A. Rudell, Torrance, Calif.

[21] Appl. No.: 854,318

[22] Filed: Mar. 19, 1992

[51] Int. Cl.[5] ..... A63H 33/30; A63H 3/52; B43K 5/18; B43K 5/10

[52] U.S. Cl. ..... 446/473; 446/267; 446/475; 401/148; 401/178

[58] Field of Search ..... 446/267, 180, 193, 195, 446/196, 197, 224, 473, 475, 483, 484, 485; 401/148, 176, 178, 188 R, 190, 232, 235

[56] References Cited

U.S. PATENT DOCUMENTS

| | | | |
|---|---|---|---|
| 2,729,024 | 1/1956 | Guttmann | 446/267 X |
| 2,833,252 | 5/1958 | Tom | 401/178 |
| 3,115,868 | 12/1963 | De Molin et al. | 401/188 R |
| 3,256,894 | 6/1966 | Sherman | 401/186 R |
| 4,538,817 | 9/1985 | Ramella | 446/220 |
| 4,750,641 | 6/1988 | Chin-Fu | 446/475 X |
| 4,768,681 | 9/1988 | Dean et al. | 446/473 X |
| 4,813,680 | 3/1989 | Rudell et al. . | |
| 4,854,480 | 8/1989 | Shindo | 446/473 X |
| 4,881,733 | 11/1989 | Rehkemper et al. . | |
| 4,890,838 | 1/1990 | Rudell et al. . | |
| 4,982,959 | 1/1991 | Rudell et al. . | |
| 4,991,847 | 2/1991 | Rudell et al. . | |
| 5,072,856 | 12/1991 | Kimble | 446/475 X |
| 5,098,095 | 3/1992 | Weiss | 446/224 X |
| 5,120,261 | 6/1992 | Dietzman | 446/473 |

FOREIGN PATENT DOCUMENTS

| | | | |
|---|---|---|---|
| 436502 | 10/1935 | United Kingdom | 446/267 |

OTHER PUBLICATIONS

Crocodile Mile, Marchon.
Duel 'n Drip, Galoob Toys.
Willy Water Bug, Wham-O Mfg. Co., 1980.
Slip 'N Slide, Wham-O Mfg. Co.
Splash Out Game, Galoob Toys.
Wet Head, Mattel Games.
Super Soakers, Larami Toys.
Fun Hydrant Sprinkler, Fisher-Price.
Bubbler Mower, Fisher-Price.
Waterbarrow, Fisher-Price.
Fire Pumper, Fisher-Price.
Blasters, LJN/Enertech.
AK Centerfire, LJN/Enertech.
Water Saturators, LJN/Enertech.
The Saturator, LJN/Enertech.
The Ripper, LJN/Enertech.
The Rat, LJN/Enertech.
Cool Potato, RTC Toys.

*Primary Examiner*—Robert A. Hafer
*Assistant Examiner*—D. Neal Muir
*Attorney, Agent, or Firm*—Blakely, Sokoloff, Taylor & Zafman

[57] ABSTRACT

A hand held toy that releases a fluid when an external pressure is applied to a portion of the toy. The toy includes a cylinder typically shaped as a sword. The sword shaped cylinder has a handle portion that can be easily grasped by a human hand. The cylinder also has a blade portion that is covered by a soft foam material, so that the blade does not injure another participant when struck by the sword. Within the handle portion of the cylinder is a fluid reservoir filled with a pressurized fluid. The reservoir is connected to a valve and a valve piston located at the opposite end of the cylinder. The valve piston and valve are adapted to move from a closed position to an open position, when an external pressure is applied to the piston. Moving the piston and valve into the open position allows fluid to flow from the fluid reservoir, through the valve and into the ambient. The toy also includes a pump connected to the fluid reservoir, so that a user can manually pressurize the fluid. To operate the toy, the user, who is typically a child, fills the reservoir with fluid and then pressurizes the same with the pump. The child can then engage another child with an identical toy. Each child maneuvers the toy and tries to press the valve piston of his sword onto the other player, so that fluid is released onto the other child.

17 Claims, 4 Drawing Sheets

CONTACT-ACTIVATED PRESSURIZED WATER RELEASE TOY

BACKGROUND OF THE INVENTION

1. FIELD OF INVENTION

This invention relates water toys, particularly a hand-held toy that releases water upon contact with another object.

2. DESCRIPTION OF RELATED ART

Toys that sell during the springtime season are often based upon the employment of water. Children love to get wet and the sales of such toys has risen dramatically during the past few years. These toys can be divided into several subcategories including water guns, water slides, and water novelties.

Water guns are either manually pump-operated or electrically powered, and allow one child to squirt another from a distance. One type of manually pressurized water gun is sold by Larami Toys under the name SUPER SOAKER. This product has a chamber that is filled with water and then manually pumped by sliding a shotgun-like pump mechanism. Upon the release of a trigger, a continuous stream of water will be emitted from the gun.

Toys sold by Marchon under the trademark CROCODILE MILE, and Wham-O, Inc. under the trademark SLIP N SLIDE, include water slides that receive a continuous supply of water from a garden hose. The water is released over a large polyethylene mat that is laid out on the lawn. The water and mat provide a slippery surface that the users can slide on.

U.S. Pat. No. 4,982,959 issued to Rudell et al, discloses a Water Sprinkler Mat Game that has been marketed by Ohio Art Company under the trademark LEAKY PIPES. The Rudell toy includes a heat sealed mat with numerous holes that emit streams of water, upon which a game of physical dexterity is played.

U.S. Pat. Nos. 4,890,838 and 4,991,847 issued to Rudell et al, disclose water novelties sold by Lewis Galoob Toys under the trademark SPLASH OUT. The toy comprises a two-piece ball that is molded with slots in an outer housing. A water balloon is loaded into the ball, and a mechanical timer is wound. Children throw the ball back and forth. As the timer runs out, a spring-loaded pin is activated, puncturing the ball and releasing the water onto the player who is holding the ball.

Another toss-around ball-like product is described in U.S. Pat. No. 4,881,733 issued to Rehkemper et al. The Rehkemper patent discloses a plastic housing that is attached to a water balloon. The balloon and housing are thrown about by two or more players. The housing has a pin that punctures the balloon and releases water on one of the players.

Another water novelty toy is sold by Fisher-Price under the name FUN HYDRANT SPRINKLER. These large molded toys are attached to garden hoses and operate in a manner similar to the SLIP AND SLIDE or CROCODILE MILE toys described earlier, except that the FUN HYDRANT SPRINKLER emits springs of water through which the children run around. There is no mat to run or slide on. The Fisher-Price toy is therefore much safer than the water slide mats. None of these toys offer one-on-one competition, being activity items they are not competitive in nature.

U.S. Pat. No. 4,813,680 issued to Rudell et al, discloses a toy that was sold by Mattel under the trademark WET HEAD. That toy involves a hat-like device with a water chamber whose contents are released upon the head of the wearer as he removes numerous identical removable sticks, one of which is effectively functioning as a release valve stop.

Also included in the art are projectile devices that release water upon impact with another object. One such toy is sold by Kenner Products under the name SPLASH DARTS. The dart holds water in a sponge-like manner and provides a single release of water, when thrown onto a rigid surface.

Another projectile device is a flying disc "Frisbee", that is constructed from a foam sponge-like material. A player will get wet if he catches the water-soaked disc too close to his body. Neither one of these toys have any provision for momentary, pressurized release of a liquid, nor are they logically held by one player for skillful direction into contact with an opponent.

Parker Brothers and Kenner Products sell Nerf Fencing Swords, which comprise hand-held swords that allow children to play-duel. On the hilt of each sword is a polyethylene living-hinge target with multiple folding sectors. Each time an opponent successfully touches a hilt-sector with his sword tip, one of the sectors folds down. The folding down of the sectors serves as a means for proficiency scoring. It should be noted that there is no water usage suggested or implied by this product, nor is there any penalty attributed to the player who eventually loses the match.

What is desired is a toy that allows two or more players to engage in play competition such as "dueling", wherein the loosing player is penalized with a splash of water upon contact by an opponent's sword. The wet penalty offers great summertime fun.

SUMMARY OF THE INVENTION

The present invention is a hand held toy that releases a fluid when an external pressure is applied to a portion of the toy. The toy includes a cylinder typically shaped as a sword. The sword shaped cylinder has a handle portion that can be easily grasped by a human hand. The cylinder also has a blade portion that is covered by a soft foam material, so that the blade does not injure another participant when struck by the sword.

Within the handle portion of the cylinder is a fluid reservoir filled with a pressurized fluid. The reservoir is connected to a valve and a valve piston located at the opposite end of the cylinder. The valve piston and valve are adapted to move from a closed position to an open position, when an external pressure is applied to the piston. Moving the piston and valve into the open position allows fluid to flow from the fluid reservoir, through the valve and into the ambient.

The toy also includes a pump connected to the fluid reservoir, so that a user can manually pressurize the fluid. To operate the toy, the user, who is typically a child, fills the reservoir with fluid and then pressurizes the same with the pump. The child can then engage another child with an identical toy. Each child maneuvers the toy and tries to press the valve piston of his sword onto the other player, so that fluid is released onto the other child. The toy is constructed so that multiple "hits" of the valve may be accomplished, before the reservoir must be repressurized or refilled.

Therefore it is an object of this invention to provide a toy that allows two players to engage in a sword fight, wherein one of the players is splashed with water when the tip of the sword is pressed against him.

It is also an object of this invention to provide a fluid filled sword that provides multiple releases of fluid upon sequential strikes of the sword tip.

It is also an object of this invention to provide a fluid filled sword that is safe to use, easy to operate and inexpensive to produce.

It is also an object of this invention to provide a toy that produces a pressurized stream of fluid upon contact.

DETAILED DESCRIPTION OF THE

The objects and advantages of the present invention will become more readily apparent to those ordinarily skilled in the art after reviewing the following detailed description and accompanying drawings, wherein.

Figure 1:
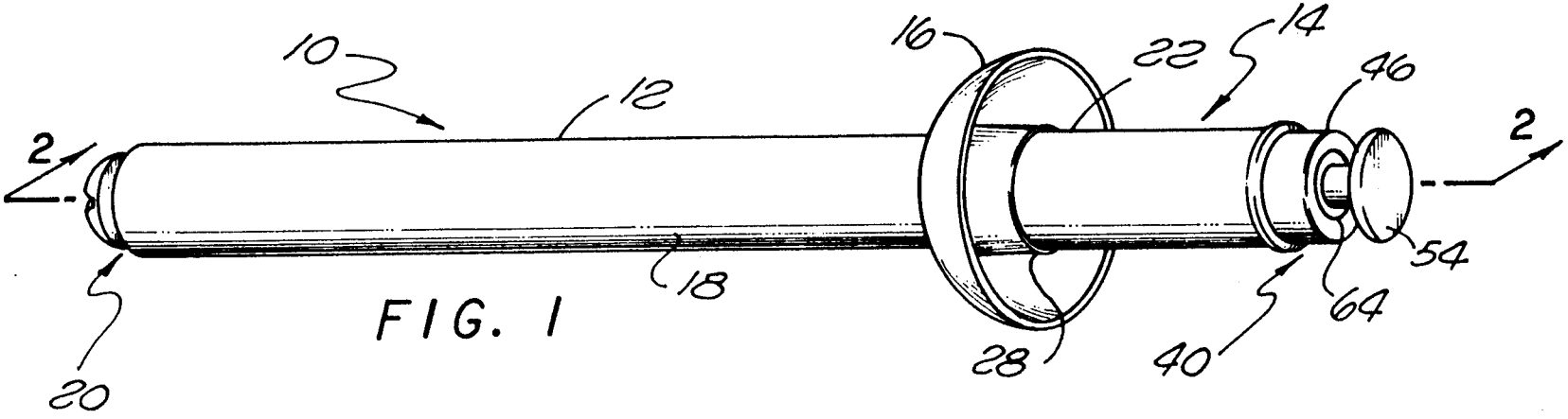
FIG. 1 is an illustration of a toy of the present invention.
Figure 2:
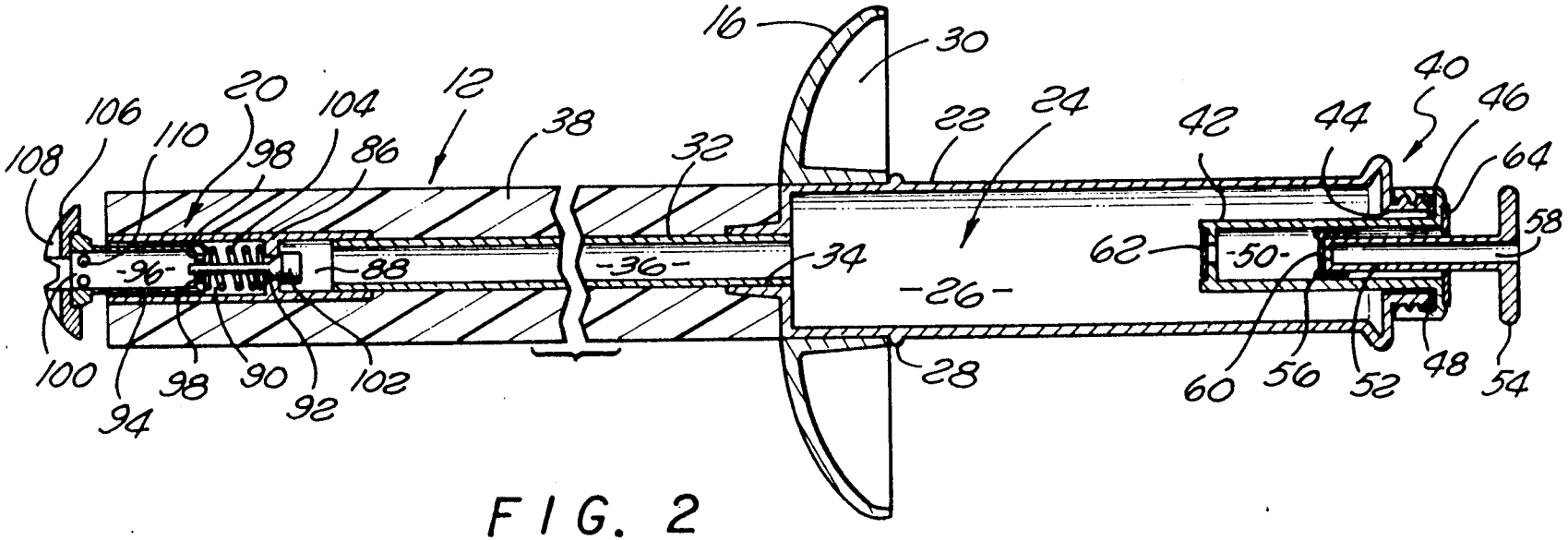
FIG. 2 is a cross-sectional view of the toy shown in FIG. 1.
Figure 2A:
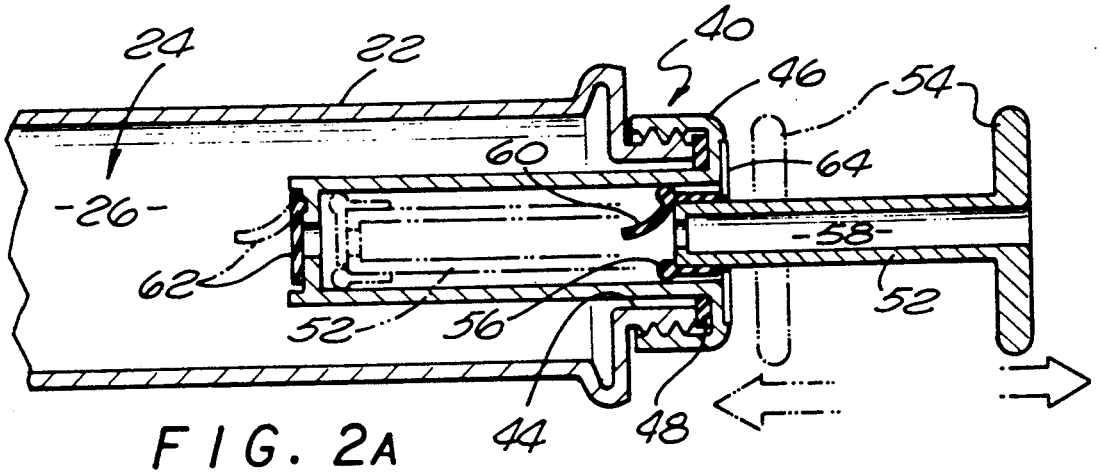
Figure 3:
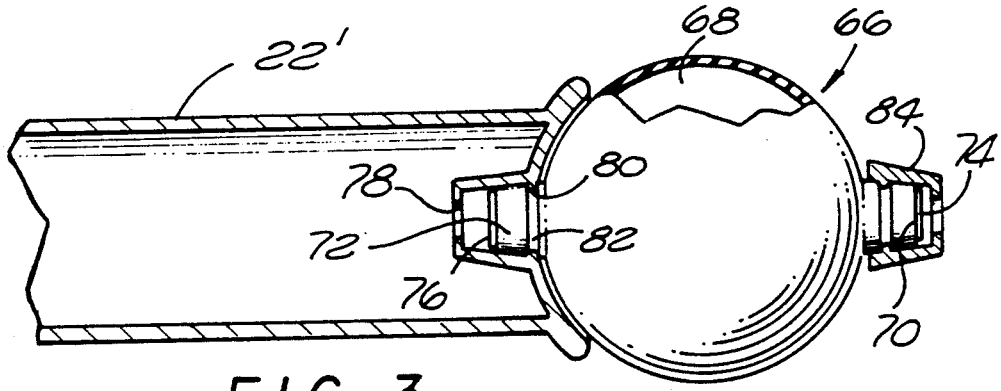
Figure 4:
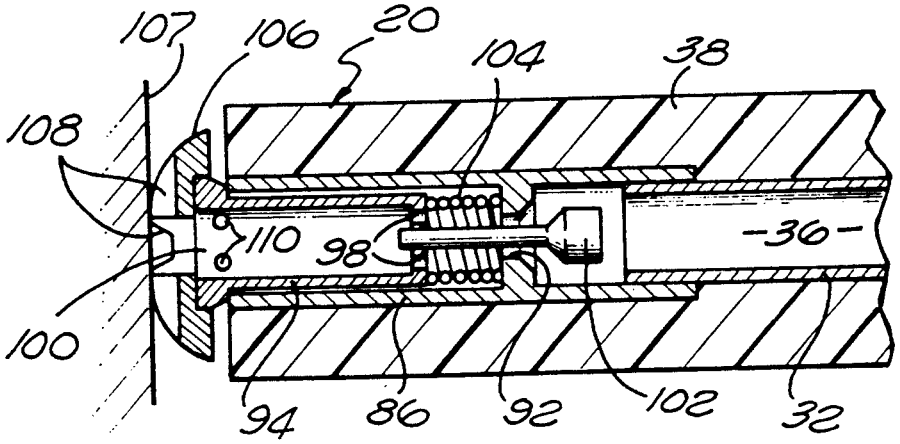
Figure 5:
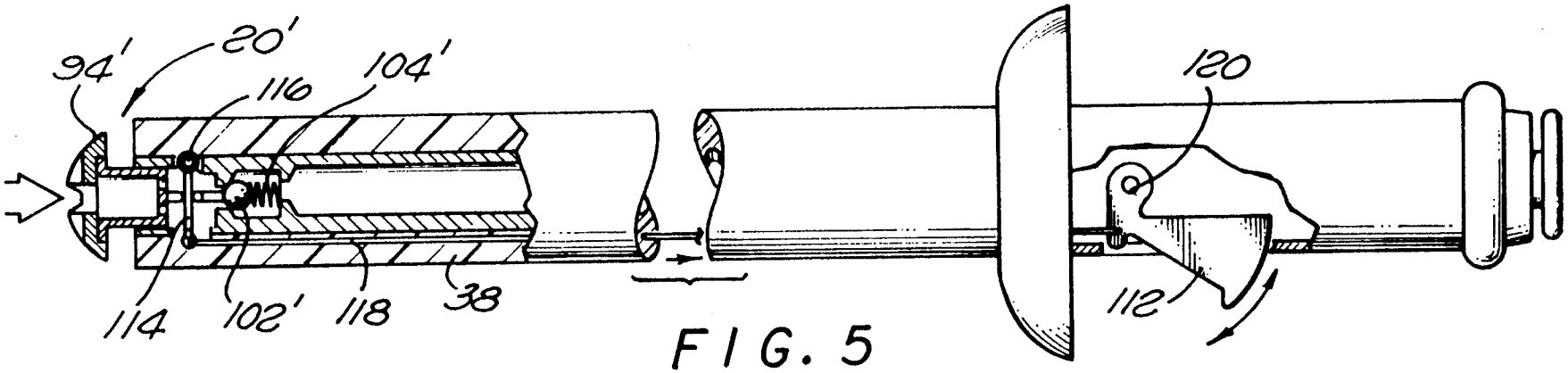
Figure 7:
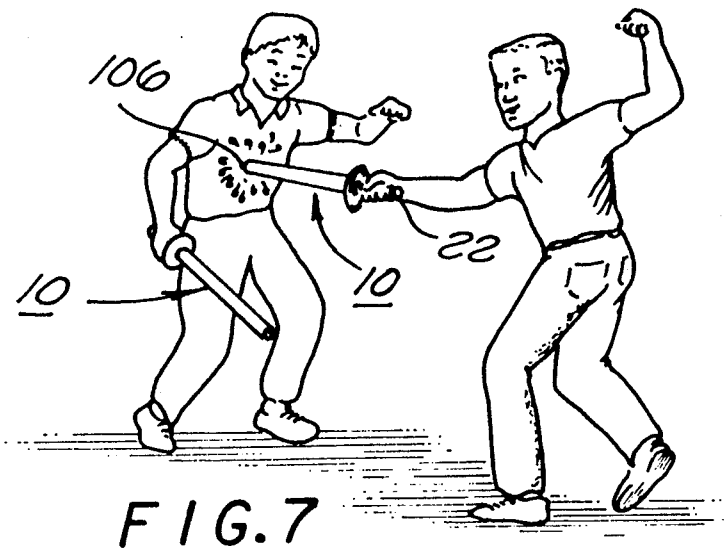
Figure 6:
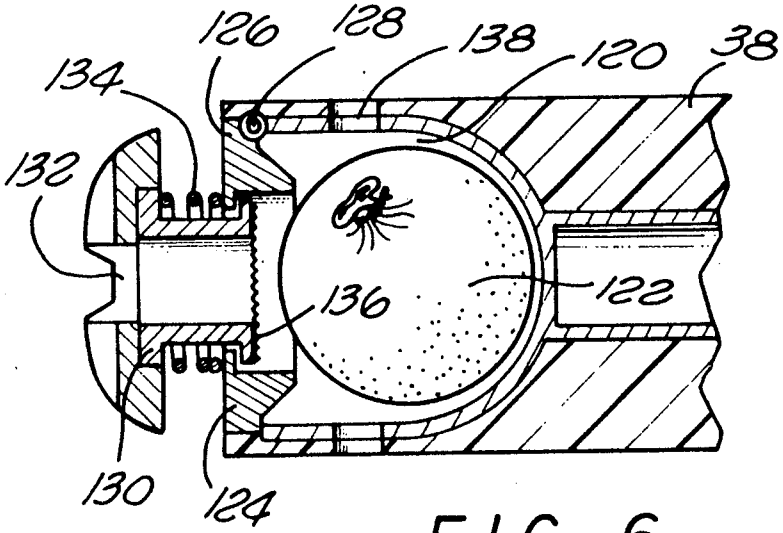
Figure 8:
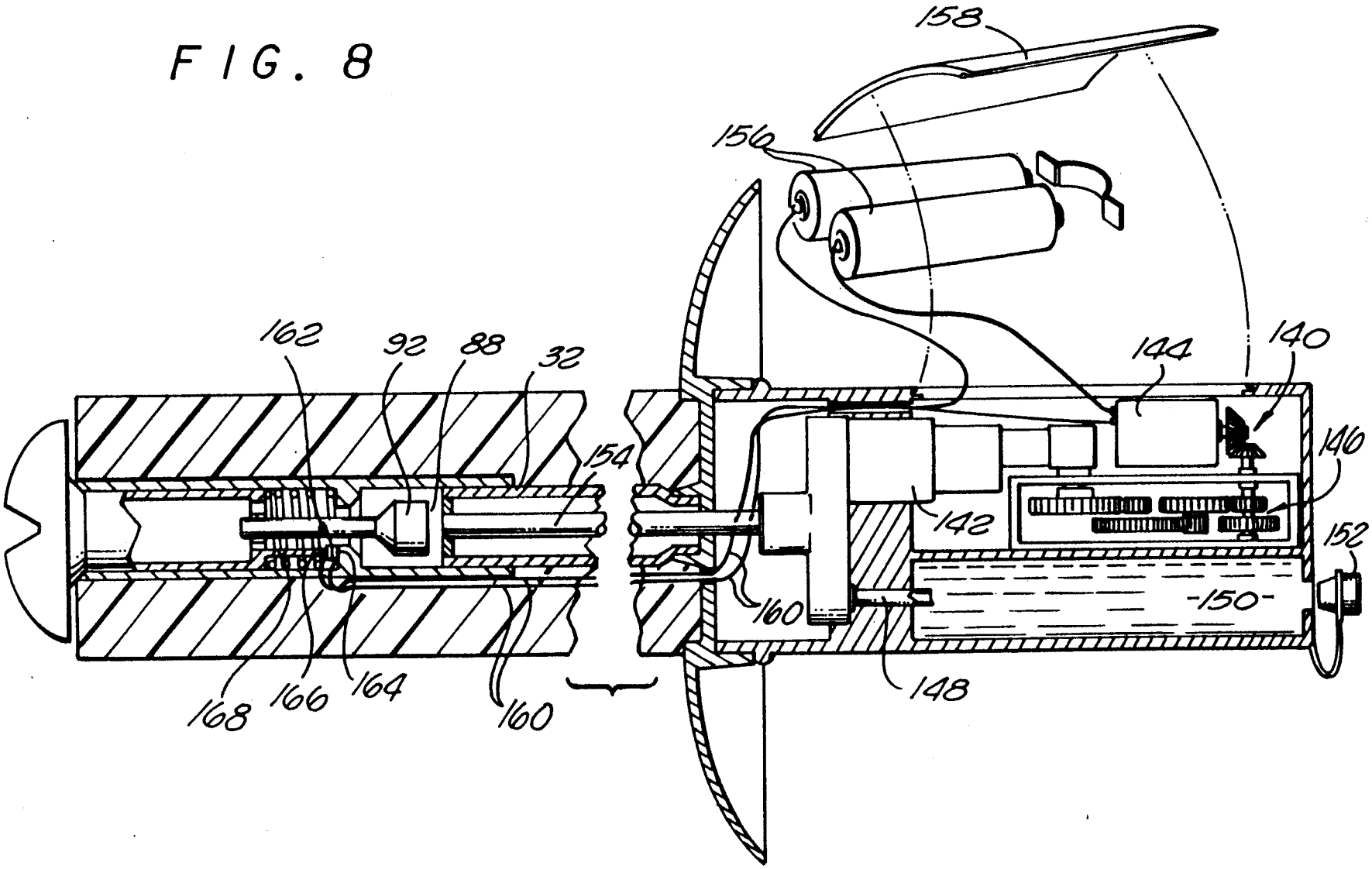

FIG. 2*a* is a cross-sectional view similar to FIG. 2, showing the pump being operated;

FIG. 3 is a cross-sectional view similar to FIG. 2, showing an alternate embodiment of a pump attached to the handle of the toy;

FIG. 4 is a cross-sectional view similar to FIG. 2, showing the valve assembly being depressed, such that fluid is released from the toy;

FIG. 5 is a cross-sectional view similar to FIG. 2, showing a trigger connected to the valve, so that fluid may be released from the toy by depressing the trigger;

FIG. 6 is a cross-sectional view showing an alternate embodiment of the toy of FIG. 1;

FIG. 7 is an illustration of two children using toys of the present invention;

FIG. 8 is a cross-sectional view showing another alternate embodiment of the toy of FIG. 1.

DETAILED DESCRIPTION OF THE INVENTION

Referring to the drawings more particularly by reference numbers, FIG. 1 shows a toy 10 of the present invention. The toy 10 is typically a cylinder 12 that is shaped as a sword. The cylinder 12 has a handle portion 14 which is adapted to be held by a human hand. The handle portion 14 may have perforations (not shown) or other means to improve the grip of the sword. Adjacent to the handle portion 14 is a hilt 16 that separates a blade portion 18 from the handle 14. The hilt 16 also provides a means to further secure the hand to the toy 10. At the end of the blade portion 18 is a valve assembly 20 which releases fluid when pressed against an object. Although a sword is described, it is to be understood that the toy could be shaped as other objects such as a javelin or an arrow, whereby the valve assembly 20 releases the fluid when the toy strikes an object.

As shown in FIG. 2, the cylinder 12 includes a handle housing 22 that functions as both the handle 14 and a fluid reservoir 24. The fluid reservoir 24 contains a fluid 26 such as water. In the alternative, the fluid could be a colored liquid commonly known in the art as "disappearing ink". When the ink is released onto an object, the object retains the color of the liquid, until the ink evaporates into the air. The handle housing 22 may also have an annular ridge 28 that allows the hilt 16 to be attached thereto. The hilt 16 preferably has an inner annular cavity 30, that allows the hand to more securely grasp the toy and more accurately replicates a "real" sword.

A tube 32 is inserted into a first opening 34 of the handle housing 22. The tube 32 has a channel 36 that provides fluid communication between the fluid reservoir 24 and the valve assembly 20. The tube 32 is surrounded by a foam housing 38 which is typically constructed from a molded closed cell foam. Such material is presently sold by Parker Bros. under the trademark NERF. When the toy strikes another person, the foam housing 38 dampens the impact and reduces the probability of injury. The remaining parts of the toy are typically constructed from a hard plastic such as a high impact styrene, polyethylene or polypropylene Although the handle housing 22, hilt 16 and tube 32 are shown as separate pieces, it is to be understood that these members may be constructed as one homogeneous part.

Attached to the fluid reservoir 24 is a pump assembly 40 that allows the user to pressurize the fluid 26 within, the reservoir 24. The assembly 40 has a pump housing 42 that is inserted into a second opening 44 of the handle 22. Integrated with the pump housing 42 is a threaded cap 46 that allows the pump assembly 40 to be screwed onto the handle 22. The cap 46 contains a gasket 48 that further seals the assembly 40 thereto. The pump housing 42 has an internal passage 50 which contains the shaft 52 of a pump handle 54. Attached to the shaft 52 is an O-ring 56 which seals the internal passage 50. The pump handle 54 has a channel 58 that can provide communication between the passage 50 and the ambient. Attached to the handle 54 is a first rubber flapper valve 60 that allows one-way flow from the channel 58 to the passage 50. The housing 42 has a second rubber flapper valve 62 that allows one-way flow from the passage 50 to the reservoir 24. The pump housing 42 may also include a retainer ring 64 that guides the handle 54, so that it moves in a linear manner within the passage 50.

To pressurize the reservoir 24, the user pulls the pump handle 54 in the direction indicated by the arrow. The movement of the shaft 52 creates a vacuum in the passage 50. The pressure differential across the first valve 60 opens the same and allows air to flow into the passage 50. The second valve 62 remains closed so that the air remains in the passage 50. As shown in FIG. 2*a*, when the user pushes the handle 54 back into the passage 50, the shaft 52 pushes the air through the second valve 62 and into the reservoir 24. The cycle is repeated until the reservoir 24 is sufficiently pressurized. The user is able to sense the pressure within the toy by the resistance of the handle 54 as it is being pushed into the passage 50.

FIG. 3 shows an alternate embodiment of a pump assembly 66. The assembly 66 has a hollow bladder 68 with an inlet 70 and an outlet 72, that allow air to flow therethrough. Attached to the inlet 70 is a third flapper valve 74 that allows one-way flow from the ambient into the bladder 68. The outlet 72 has a fourth flapper valve 76 that allows one-way flow from the bladder 68 to the reservoir 26. The handle housing 22' is constructed to have a port 78 that receives the outlet 72. The port 78 has an annular ridge 80 that can fit within an annular groove 82 in the outlet 72, to 20 connect the bladder 68 to the handle 22'. The ridge and groove configuration, allows the user to easily snap the bladder 68 into the handle 22'. A cap 84 may be placed around the inlet 70, to protect the third valve 74.

To operate the pump assembly 66, the user squeezes the bladder 68, such that the air within the bladder 68 flows through the fourth valve 76 and into the reservoir 24. When the bladder 68 is released, it returns to the original shape and creates a vacuum within. The pressure differential causes a flow of air through the third valve 74 and into the bladder 68. The bladder 68 is then squeezed, again pushing air into the reservoir 24. The cycle is repeated until the reservoir is sufficiently pressurized.

As shown in FIG. 2, the valve assembly 20 includes a valve housing 86 that is attached to the tube 32. The valve housing 86 has a first chamber 88, a second chamber 90 and a valve opening 92 that allows fluid communication between the chambers. Extending from the valve housing 86 is a valve piston 94 that can move within the second passage 90. The valve piston 94 has a passage 96, and openings 98 that allow fluid communication between the second chamber 90 and the passage 96. The piston 94 also has an opening 100 that provides fluid communication between the passage 96 and the ambient.

A valve 102 extends through the opening 92 and is connected to the valve piston 94. The piston 94 and valve 102 can move from a closed position, wherein fluid cannot flow through the opening 92, to an open position such that fluid can flow through the opening 92. The second chamber 90 contains a spring 104 that biases the valve 102 into the closed position. The valve piston 94 also has a contact tip 106 that is adapted to engage an external object.

As shown in FIG. 4, to open the valve 102 the contact tip 106 is pressed against an object 107. A pressure is applied to the piston 94, to overcome the spring 104 and move the valve 102 into the open position. The pressurized fluid 26 within the tube 32 flows through the valve opening 92, across the passage 96 and out into the ambient through the opening 100. When the tip 106 is released from the object, the spring 104 returns the valve 102 to the closed position. Subsequent contact with an object will open the valve 102 and release fluid from the valve assembly 20.

The contact tip 106 may have grooves 108 that provide a passage for the fluid to flow, when the top surface of the tip 106 is covered by the object 107. Additionally, the piston 94 may have a plurality of holes 110 that allow fluid to flow in a direction perpendicular to the opening 100. The holes 110 provide more of a "splash" when the valve assembly 20 is engaged by the object.

FIG. 5 shows an alternate embodiment of the toy, that incorporates a trigger 112 which can release water from the valve assembly 20'. The valve 102' is attached to a rocker arm 114 that can rotate about a hinge 116. The arm 114 is attached to a linkage rod 118 that couples the trigger 112 to the valve 102'. The rod 118 is typically a wire that extends through the foam material 38. The trigger 112 is adapted to rotate about a hinge 120, so that when the trigger 112 is depressed, the rod 118 is pulled in the direction indicated by the arrow. Movement of the rod 118 rotates the arm 114 and opens the valve 102', thereby allowing fluid to flow out of the piston 94' and into the ambient. When the trigger 112 is released, a spring 104' returns the valve 102' and trigger 112 to the original closed positions. The trigger mechanism allows the user to release fluid without having to depress the contact tip 106.

FIG. 6 shows another alternate embodiment of the toy. The foam material 38 has a cavity 120 formed therein, which contains an inflatable balloon 122 filled with a fluid. The cavity 120 is also defined by a cover 124 that has a lid 126. The lid 126 can rotate about a hinge 128, to provide ready access to the cavity 120. A valve piston 130 extends from the cover 126 and has an opening 132 that provides fluid communication between the cavity 120 and the ambient. A spring 134 is captured between the piston 130 and the cover 124 to bias the piston 130 into an extended position.

The piston 130 has puncture means 136 that can penetrate and rupture the balloon. The puncture means 136 may be sandpaper or some other course material. When the piston 130 is pressed against an object, the puncture means 136 engage the balloon 122, breaking the same and allowing the released fluid to flow through the piston 130 and into the ambient. To reuse the device, the lid 126 must be rotated to remove the deflated balloon and install a new inflated balloon. The cover 126 may have additional openings 138, to allow fluid to flow out of the sides of the toy. The present embodiment can be used without the reservoir and pump assemblies described above, whereby there is provided a source of pressurized fluid adjacent to the valve piston 130.

To operate the toys described and shown in FIGS. 1-5, the user must remove the pump assembly (either unscrew the cap 46 of FIG. 2, or detach the bladder 66 of FIG. 3), and fill the reservoir 24 with fluid. The pump assembly is then attached to the handle 22 and the fluid is subsequently pressurized by manipulating the pump. As shown in FIG. 7, the user, who is typically a child, can engage another player in a "sword fight". Each child tries to maneuver himself and the toy so that he can position himself to press the contact tip 106 of his sword against the other child. Depressing the tip releases fluid onto the other child, thereby providing an indication of the number of "hits" each player as registered. The spring return action of the tip allows the user to administer a series of hits to the other player. If the trigger 112 is incorporated, the players may release water without contact, thereby providing additional strategy during play. The participants can use the blade portions to strike the other player and to deflect the blows of the opponent. The foam material dampens the impact and prevents injury to the users. Thus what is described is a hand held toy that releases fluid upon contact with the another player.

FIG. 8 shows another alternate embodiment that has a battery powered pump assembly 140 in the handle portion 14 of the toy. The pump assembly 140 has a pump 142 coupled to an electric motor 144 by a gear assembly 146. The gear assembly 146 provides gear reduction between the motor 144 and pump 142. The pump 142 has an inlet tube 148 connected to a reservoir 150 that contains fluid 26. The reservoir 150 has a fill cap 152 that allows the reservoir 150 to be filled with the fluid 26. The pump 142 also has an outlet tube 154 that extends through tube 32. Alternately, the outlet tube 154 can be connected to tube 32, such that fluid flows through tube 32.

The pump assembly 140 is powered by batteries 156 that are located within the handle portion 14. The handle portion 14 may have a cover 158 that provides access to the batteries 156. The batteries 156 are coupled to the electric motor 144 by a pair of wires 160 that are connected to a switch 162. The switch 162 includes a metal contact 164 on the valve housing 86 and a metal contact 166 on a finger 168 that extends from the piston 94.

When the piston 94 is pushed inward, the metal contacts 164 and 166 are pushed together, thereby closing the circuit between the batteries 156 and the electric motor 144. The motor 144 is energized and drives the pump 142. The pump 142 pumps fluid from the reservoir 150 into the chamber 88. The valve 92 is also open, wherein the fluid flows into the ambient, typically as a pressurized stream. The pump assembly 140 provides a constant source of pressurized fluid without having to pressurize the reservoir as required in the embodiments described above.

While certain exemplary embodiments have been described in detail and shown in the accompanying drawings, it is to be understood that such embodiments are merely illustrative of and not restrictive on the broad invention, and that the present invention not be limited to the specific construction and arrangements shown and described, since various other modifications may occur to those ordinarily skilled in the art.

What is claimed is:

1. A toy, comprising:

a cylinder;

a fluid reservoir within said cylinder, said fluid reservoir being capable of containing a fluid;

a valve piston having a passage and being operatively connected to said cylinder, said valve piston further having an aperture essentially perpendicular to said passage and a tip that has a groove in fluid communication with said passage;

a valve attached to said valve piston, said valve piston and said valve being adapted to move between an open position and a closed position, wherein said fluid reservoir is in fluid communication with said passage when said valve is in said open position;

biasing means for biasing said valve piston and said valve into said closed position to prevent fluid communication between said fluid reservoir and said valve piston passage, wherein said valve piston and said valve moves into said open position such that said fluid flows from said fluid reservoir into said valve piston passage, said aperture and said tip groove when an external pressure is applied to said tip.

2. The toy as recited in claim 1, wherein said fluid reservoir is pressurized.

3. The toy as recited in claim 2, wherein said fluid is pressurized with a pump operatively connected to said cylinder and said fluid reservoir.

4. The toy as recited in claim 3, wherein said pump has a bladder connected to a pair of one-way valves, such that operation of said bladder induces a flow of air from the ambient to said fluid reservoir through said one-way valves.

5. The toy as recited in claim 3, wherein said pump has a handle with a first one-way valve, said handle being operatively connected to a second one-way valve such that linear movement of said handle induces a flow of air from the ambient to said fluid reservoir through said one-way valves.

6. The toy as recited in claim 3, wherein said pump is operatively connected to an electric motor that is powered by at least one battery, said electric motor and said battery being operatively connected to switch means for electrically connecting said battery and said electric motor, wherein said electric motor and said battery are connected when said external pressure is applied to said tip.

7. The toy as recited in claim 1, further comprising a trigger operatively connected to said valve and said cylinder such that when said trigger is depressed said fluid is released from said valve.

8. The toy as recited in claim 7, wherein said pump is operatively connected to an electric motor that is powered by at least one battery, said electric motor and said battery being operatively connected to switch means for electrically connecting said battery and said electric motor, wherein said electric motor and said battery are connected when said external pressure is applied to said tip said switch means being operatively connected to said trigger so that when said trigger is depressed said switch means connects said battery and said electric motor.

9. The toy as recited in claim 1, further comprising a trigger operatively connected to said valve and said cylinder such that when said trigger is depressed said fluid is released from said valve piston.

10. The toy as recited in claim 1, wherein said fluid reservoir is adjacent to said valve piston and comprises an inflatable balloon filled with said fluid, said valve piston having puncture means to rupture said balloon when said valve piston is moved into said open position, wherein said fluid flows through said passage.

11. The toy as recited in claim 1, wherein said cylinder has a handle portion and a simulated blade portion, said blade portion being covered with a foam material.

12. A toy, comprising:

a cylinder;

a fluid reservoir within said cylinder, said fluid reservoir being capable of containing a fluid;

a pump operatively connected to said cylinder and said fluid reservoir, said pump being constructed to manually pressurize said fluid within said fluid reservoir;

a valve piston operatively connected to said cylinder, said valve piston having a contact surface and a passage, said valve piston further having an aperture perpendicular to said passage and a tip that has a groove in fluid communication with said passage;

a valve attached to said valve piston, said valve piston and said valve being adapted to move between an open position and a closed position, wherein said passage is in fluid communication with said fluid reservoir when said valve is in said open position; and, a first spring operatively connected to said valve piston to bias said valve piston and said valve into said closed position to prevent fluid communication between said fluid reservoir and said passage, wherein an external pressure applied to said contact surface moves said valve piston and said valve into said open position such that said fluid flows into said valve piston, aperture and tip groove passage.

13. The toy as recited in claim 12, wherein said cylinder has a handle portion and a simulated blade portion, said blade portion being covered with a foam material.

14. The toy as recited in claim 13, wherein said pump has a bladder connected to a pair of one-way valves, such that operation of said bladder induces a flow of air from the ambient to said fluid reservoir through said one-way valves.

15. The toy as recited in claim 13, wherein said pump has a handle with a first one-way valve, said handle being operatively connected to a second one-way valve such that linear movement of said handle induces a flow of air from the ambient to said fluid reservoir through said one-way valves.

16. The toy as recited in claim 13, further comprising a trigger operatively connected to said valve and said cylinder such that when said trigger is depressed said fluid is released from said valve piston.

17. A method of engaging in a game of swordsman ship, comprising the steps of:

a) providing a sword that includes;

a cylinder having a handle portion and a blade portion, said blade portion being covered with a foam material;

a fluid reservoir within said cylinder, said fluid reservoir being capable of containing a fluid;

a pump operatively connected to said cylinder and said fluid reservoir, said pump being constructed to manually pressurize said fluid within said fluid reservoir;

a valve piston having a passage and being operatively connected to said cylinder, said valve piston further having an aperture essentially perpendicular to said passage and a tip that has a groove in fluid communication with said passage;

a valve attached to said valve piston, said valve piston and said valve being adapted to move between an open position and a closed position, wherein said fluid reservoir is in fluid communication with said package when said valve is in said open position;

biasing means for biasing said valve piston and said valve into said closed position to prevent fluid communication between said fluid reservoir and said valve piston passage, wherein said valve piston and said valve move into said open position such that said fluid flows from said fluid reservoir into said valve piston passage, said aperture and said tip groove when an external pressure is applied to said tip b) filling said fluid reservoir with said fluid;

c) pressurizing said fluid within said fluid reservoir with said pump;

d) pressing said valve means onto an object such that said valve means releases said fluid into the ambient.

* * * * *

UNITED STATES PATENT AND TRADEMARK OFFICE

CERTIFICATE OF CORRECTION

PATENT NO. : 5,256,099
DATED : October 26, 1993
INVENTOR(S) : Rudell et al

It is certified that error appears in the above-indentified patent and that said Letters Patent is hereby corrected as shown below:

At column 3, line 10 after "DETAILED DESCRIPTION OF THE" add
-- DRAWINGS --

At column 4, line 12 change "polypropylene" to
-- polypropylene. --

At column 4, line 61 between "in the outlet 72, to" and "configuration" delete "20"

At column 8, line 10 change "tip" to
-- tip,--

At column 8, line 26 add -- simulated -- before "blade portion being covered with a foam material."

Signed and Sealed this
Sixteenth Day of May, 1995

*Attest:*

*Attesting Officer*

BRUCE LEHMAN

*Commissioner of Patents and Trademarks*